US007287730B1

(12) United States Patent
Chen

(10) Patent No.: US 7,287,730 B1
(45) Date of Patent: Oct. 30, 2007

(54) FOLDABLE STAND

(76) Inventor: Yuehting Chen, P.O. Box 44-2049, Taipei (TW) 10668

( * ) Notice: Subject to any disclaimer, the term of this patent is extended or adjusted under 35 U.S.C. 154(b) by 16 days.

(21) Appl. No.: 11/448,856

(22) Filed: Jun. 8, 2006

(51) Int. Cl.
*A47G 23/02* (2006.01)

(52) U.S. Cl. ..... 248/150; 108/118; 248/166

(58) Field of Classification Search ..... 248/150, 248/165, 166; 108/118, 119
See application file for complete search history.

(56) References Cited

U.S. PATENT DOCUMENTS 4,705,247 A * 11/1987 Delmerico ..... 248/98
5,529,270 A * 6/1996 Liu ..... 248/188
5,584,254 A * 12/1996 Williams ..... 108/118
6,314,893 B1 * 11/2001 Lee ..... 108/119
6,722,618 B1 * 4/2004 Wu ..... 248/166
6,899,306 B1 * 5/2005 Huang ..... 248/150
6,923,416 B1 * 8/2005 Hsieh ..... 248/431

* cited by examiner

*Primary Examiner*—Ramon O Ramirez

(57) ABSTRACT

A foldable stand includes two lower parts and two upper parts, the two lower parts are respectively and pivotably connected to the two upper parts by two plates located between the two lower parts. Each plate has two stops on two sides thereof so as to maintain the two lower parts at an angle. Each of the two upper parts has two protrusions which can be respectively in contact with the two lower parts to maintain the angle between the two upper parts. The two lower parts can be pivoted toward each other and the two upper parts can be pivoted and positioned on two outsides of the two lower parts.

2 Claims, 10 Drawing Sheets

FOLDABLE STAND

BACKGROUND OF THE INVENTION (1) Field of the Invention

The present invention relates to a foldable stand including two upper parts and two lower parts, and the two upper parts can be pivotable relative to the lower parts.

(2) Description of the Prior Art

A conventional stand 1 for support a cutting machine is shown in FIG. 1 and generally includes two rectangular frames 2, 3 and the two frames 2, 3 are fixedly connected with each other at intermediate portions thereof. The two sides of the frame 2 are located at inner sides of the two sides of the frame 3. In order to support a cutting machine on the two upper ends of the two frames 2, 3, the two frames 2, 3 have to be fixedly connected with each other. Nevertheless, the fixed stand occupies a large space and is not convenient to carry.

The present invention intends to provide a foldable stand which includes two upper parts and two lower parts, the two lower parts can be pivotable toward each other and the two upper parts can be pivotably relative to the two lower parts. The foldable stand improves the shortcomings of the conventional stand.

SUMMARY OF THE INVENTION

The present invention relates to a foldable stand which includes a first lower part having two separated upper ends which are pivotably connected to two separated upper ends of a second lower part by two plates which are pivotably connected between the upper ends of the first lower part and the second lower part. The two upper ends of the second lower part are located at insides of the two upper ends of the first lower part. Each plate is an inverted V-shaped plate and has a first stop and a second stop extending from two sides thereof.

A first upper part has two separated lower ends and two first lugs extend from the two lower ends of the first upper part. A bar is pivotably connected between the two first lugs. The two lower ends of the first upper part are located at insides of the two upper ends of the second lower part. Two first protrusions extend from the two lower ends of the first upper part respectively. A second upper part has two separated lower ends and two second lugs extend from the two lower ends of the second upper part. The two second lugs are pivotably connected to two outsides of the two upper ends of the first lower part. Two second protrusions extend from the two lower ends of the second upper part respectively.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
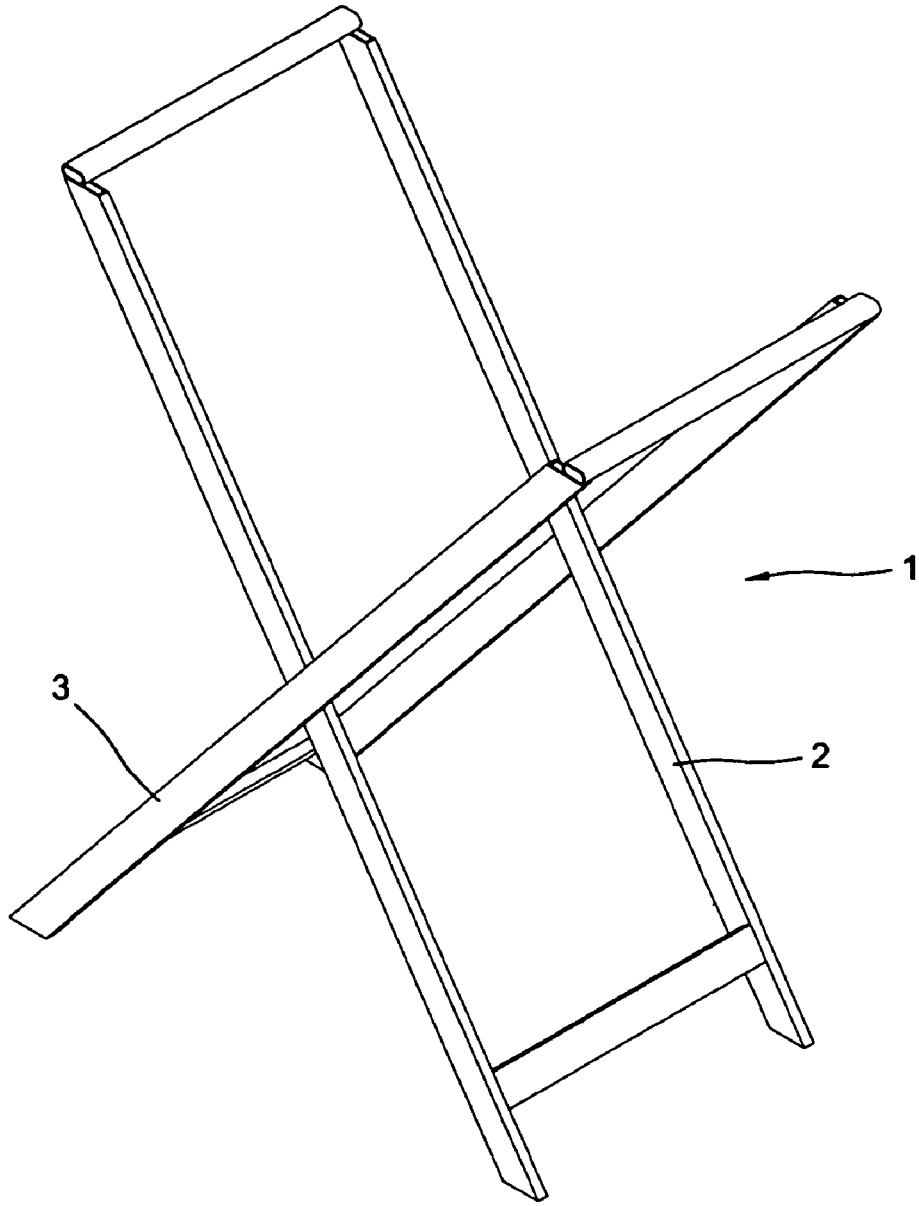
FIG.1 Prior Art
FIG. 1 is a perspective view to show a conventional foldable stand.
Figure 2:
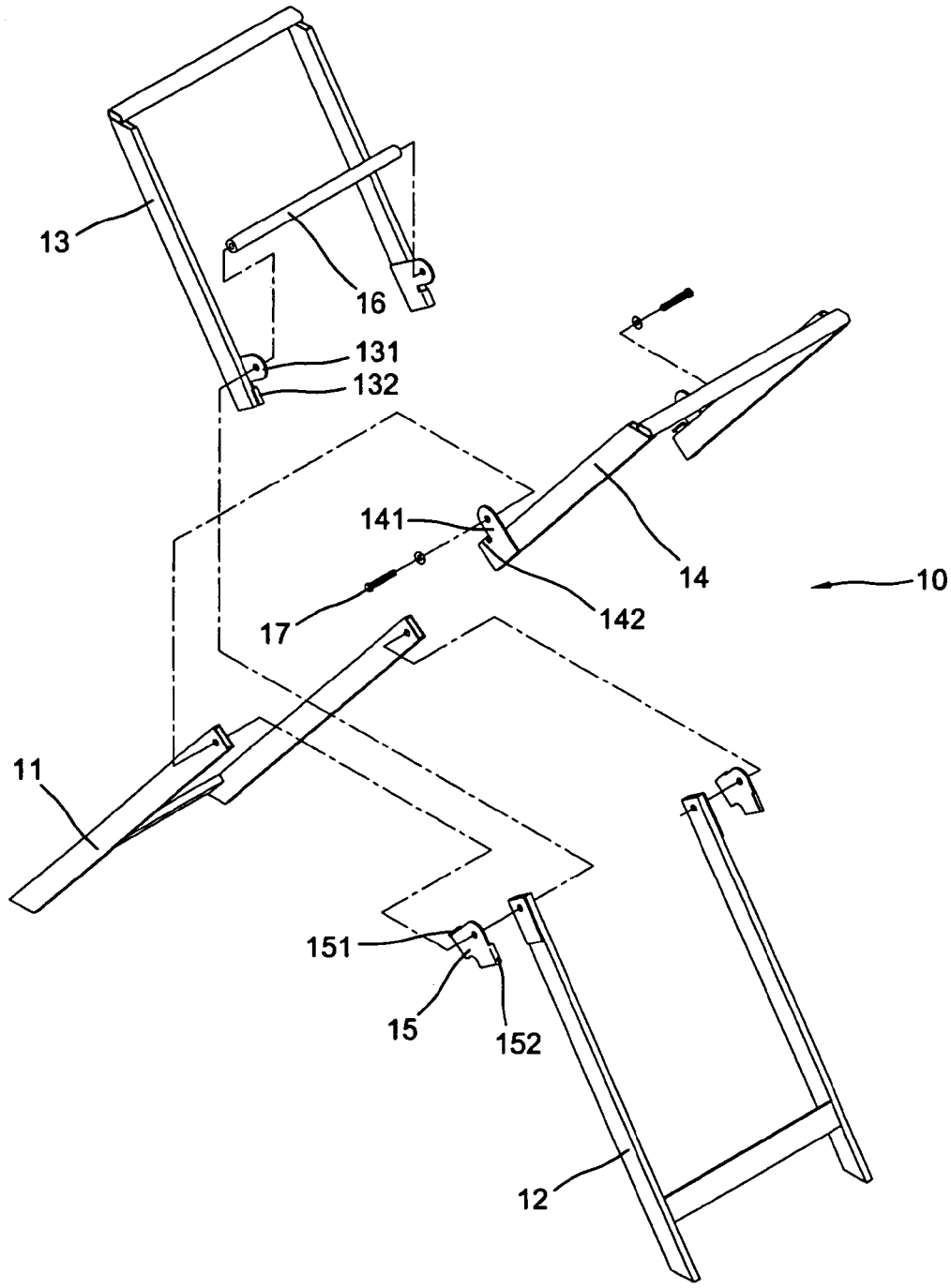
FIG. 2 is an exploded view to show the foldable stand of the present invention.
Figure 3:
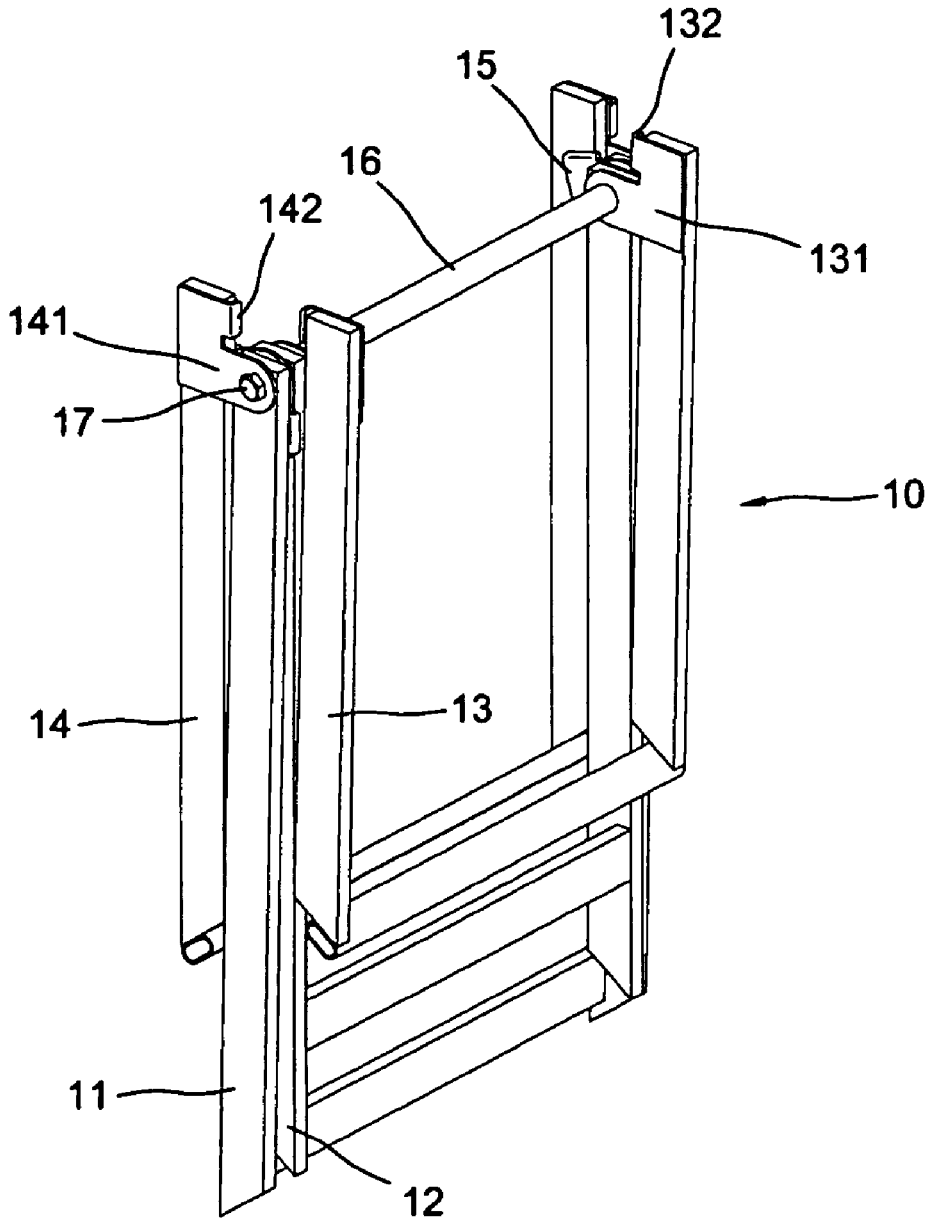
FIG. 3 shows that the foldable stand is in folded status.
Figure 4:
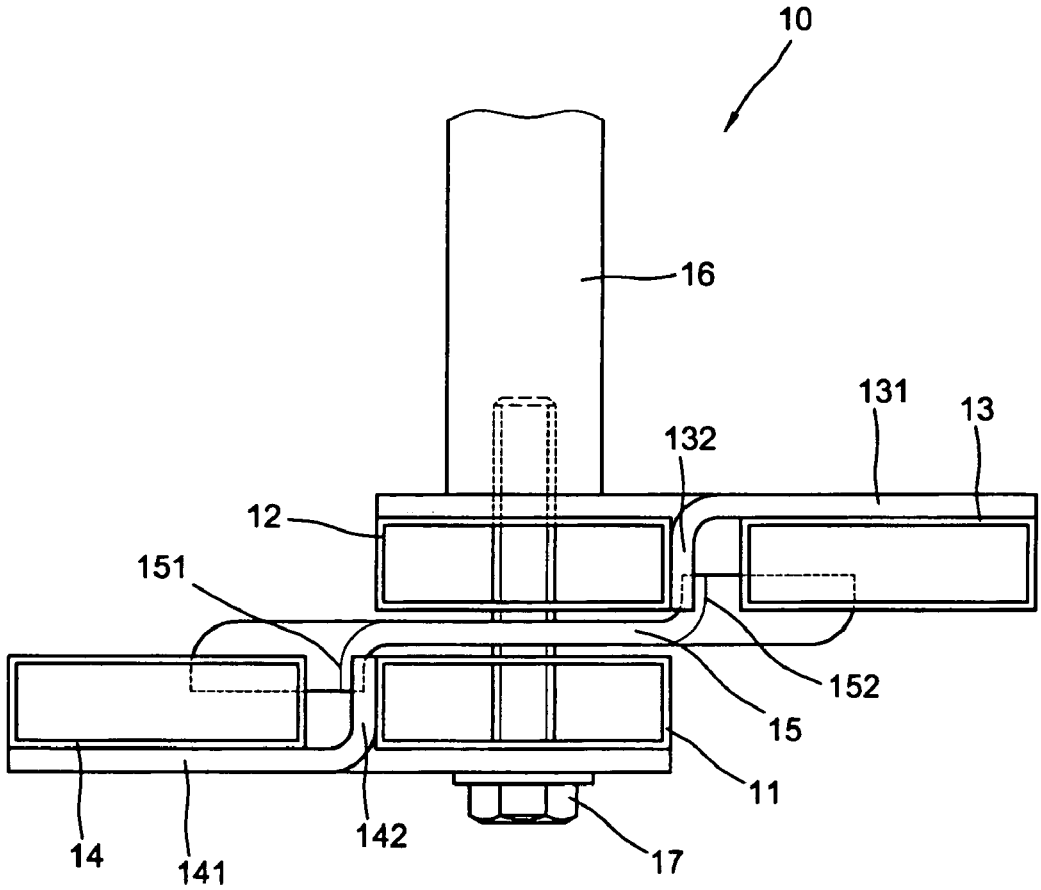
FIG. 4 is a top view to show the connection of the parts of the foldable stand of the present invention.
Figure 5:
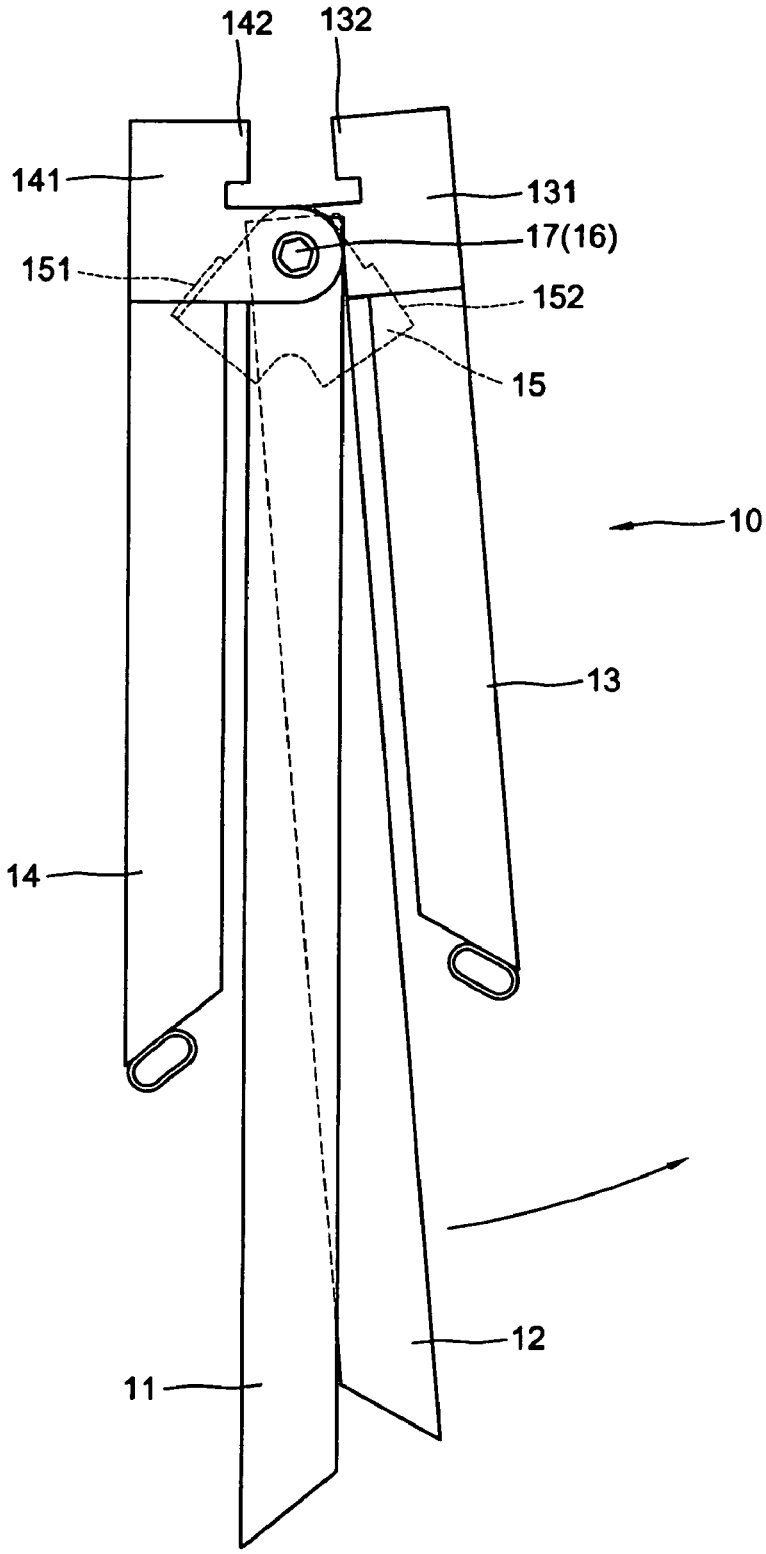
FIG. 5 shows the side view of the foldable stand of the present invention.

Referring to FIGS. 2 to 5, the foldable stand 10 of the present invention comprises a first lower part 11 having two lower ends and two separated upper ends, the two lower ends stand on the floor. A second lower part 12 has two lower ends and two separated upper ends. The two lower ends of the second lower part 12 stand on the floor. Two plates 15 are pivotably connected between the upper ends of the first lower part 11 and the second lower part 12. The two upper ends of the second lower part 12 are located at insides of the two upper ends of the first lower part 11.

Each plate 15 is an inverted V-shaped plate and has a first stop 151 and a second stop 152 extending from two sides thereof.

A first upper part 13 has two upper ends with a bar connected therebetween, and two separated lower ends. Two first lugs 131 extend from the two lower ends of the first upper part 113. A bar 16 is pivotably connected between the two first lugs 131. The two lower ends of the first upper part 13 are located at insides of the two upper ends of the second lower part 12. Two first protrusions 132 extend from the two lower ends of the first upper part 13 respectively.

A second upper part 14 has two upper ends with a bar connected therebetween, and two separated lower ends. Two second lugs 141 extend from the two lower ends of the second upper part 14. The two second lugs 141 are pivotably connected to two outsides of the two upper ends of the first lower part 11. Two second protrusions 142 extend from the two lower ends of the second upper part 14 respectively. Two bolts 17 each extend through the second lugs 141, the first lower part 11, the plate 15, the second lower part 12, the first upper part 13 and one of two ends of the bar 16.

Figure 6:
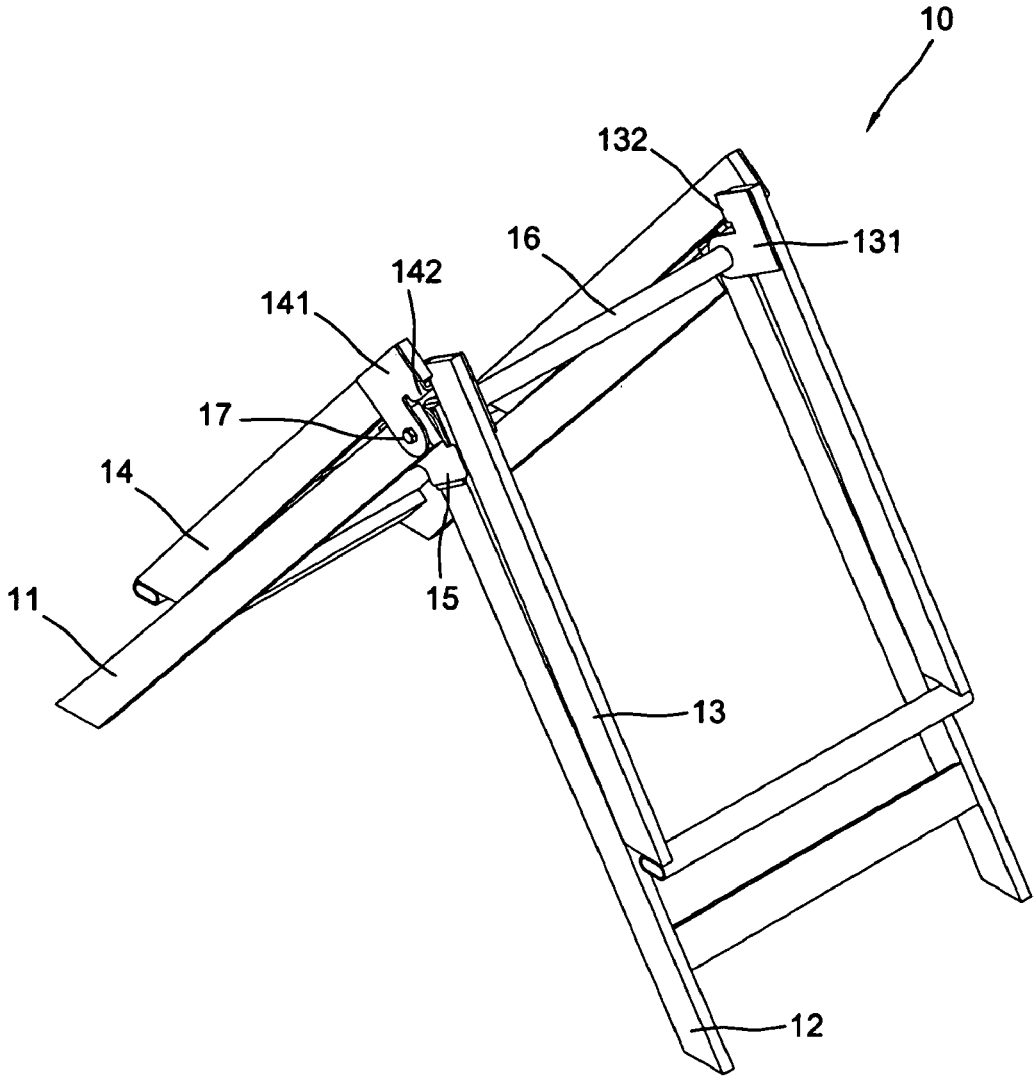
FIG. 6 shows that the two lower parts are opened apart and the two upper parts are not yet pivoted upward.
Figure 7:
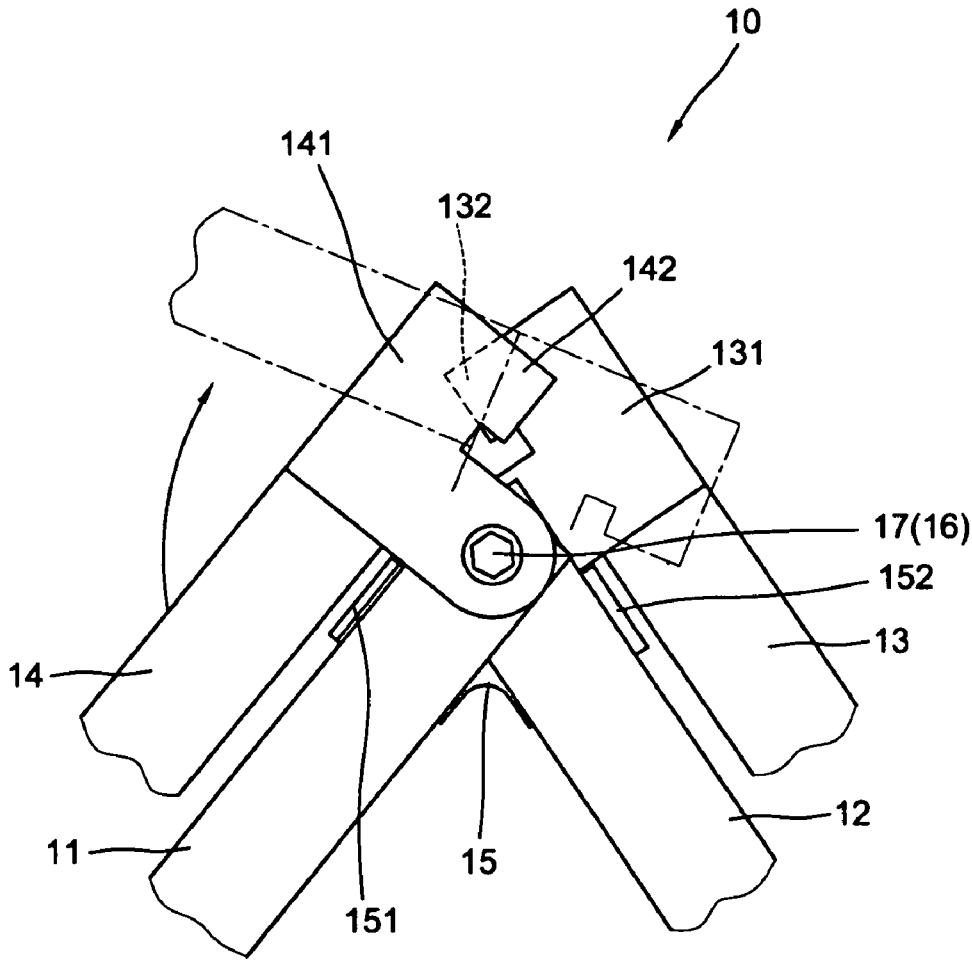
FIG. 7 shows that the two upper parts are to be pivoted upward.

As shown in FIGS. 6 and 7, when the first and second lower parts 11, 12 are pivoted about the plates 15 an angle, the first stops 151 are in contact with the first lower part 11 and the second stops 152 are in contact with the second lower part 12. By this way, the angle between the first and second lower parts 11, 12 can be set.

Figure 8:
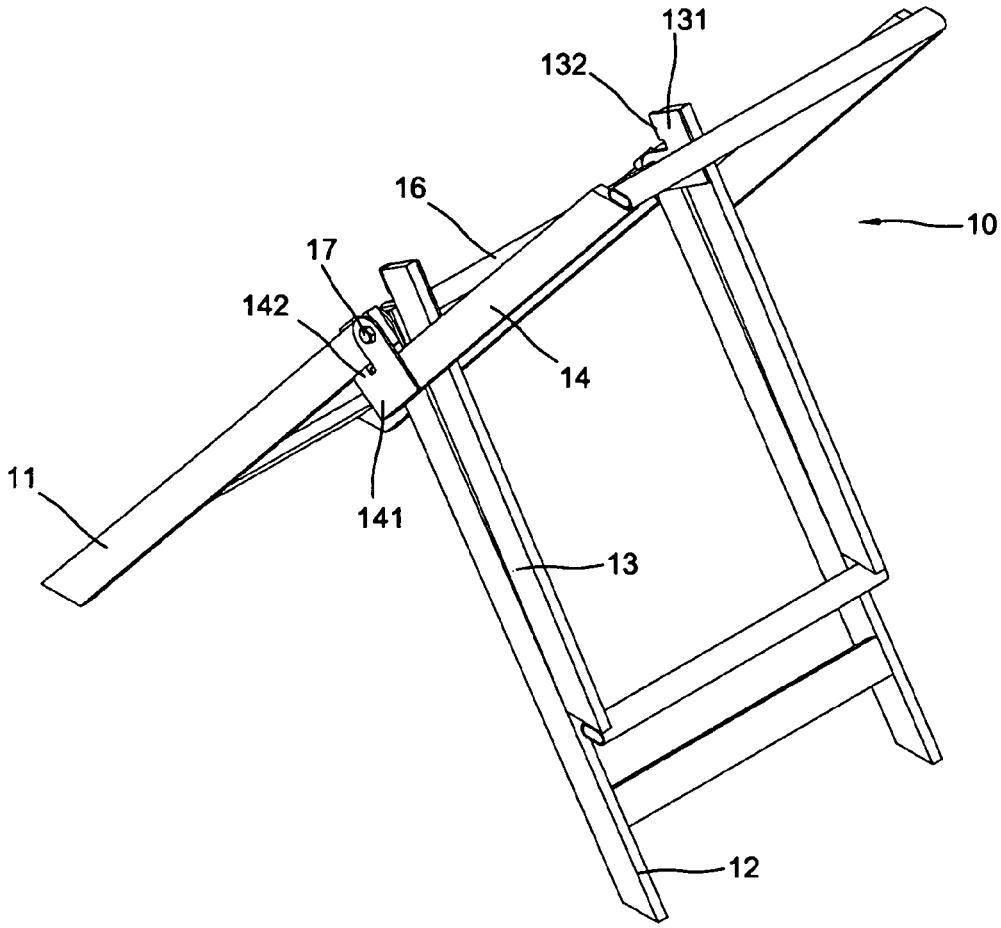
FIG. 8 shows that one of the two upper parts is pivoted upward.
Figure 9:
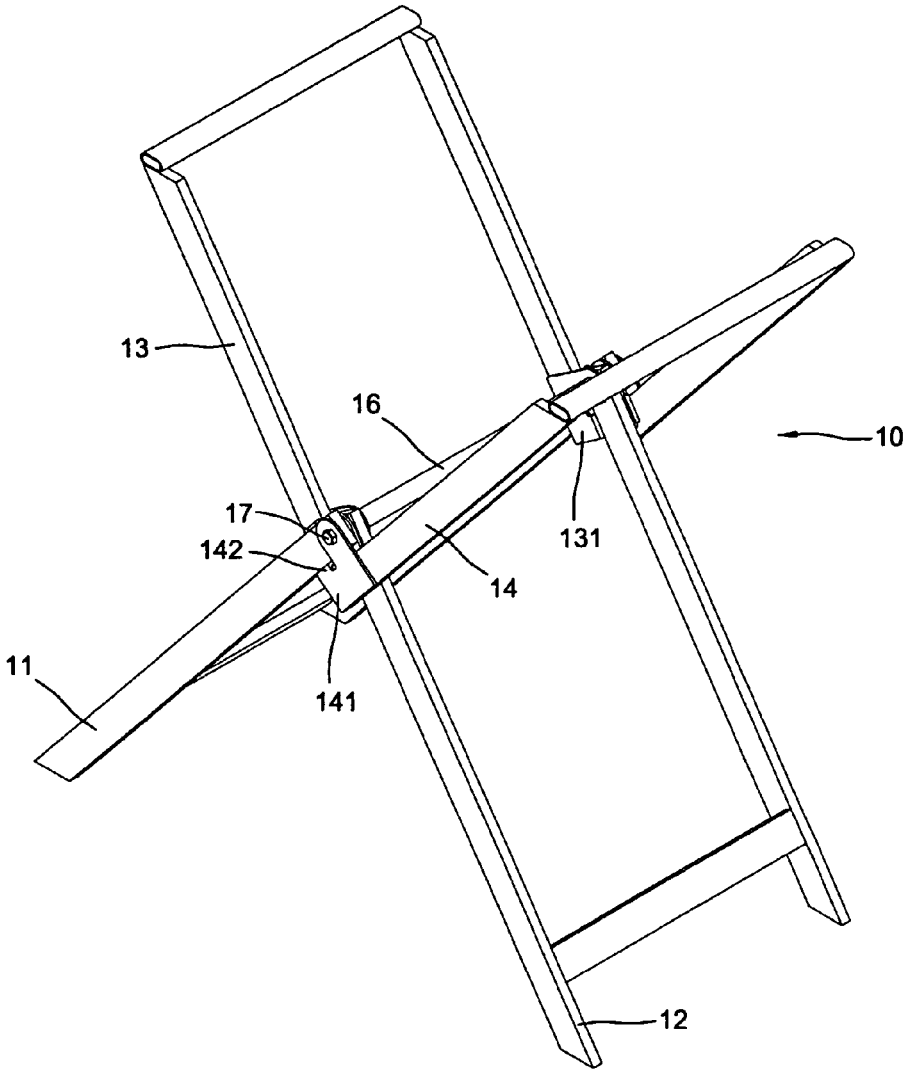
FIG. 9 shows that both of the two upper parts is pivoted upward.

As shown in FIGS. 8 and 9, the first upper part 13 and the second upper part 14 are then be pivoted upward, the two first protrusions 132 are in contact with the second lower part 12 and the two second protrusions 142 are in contact with the first lower part 11. The first and second upper parts 13, 14 are then positioned at the angle.

Figure 10:
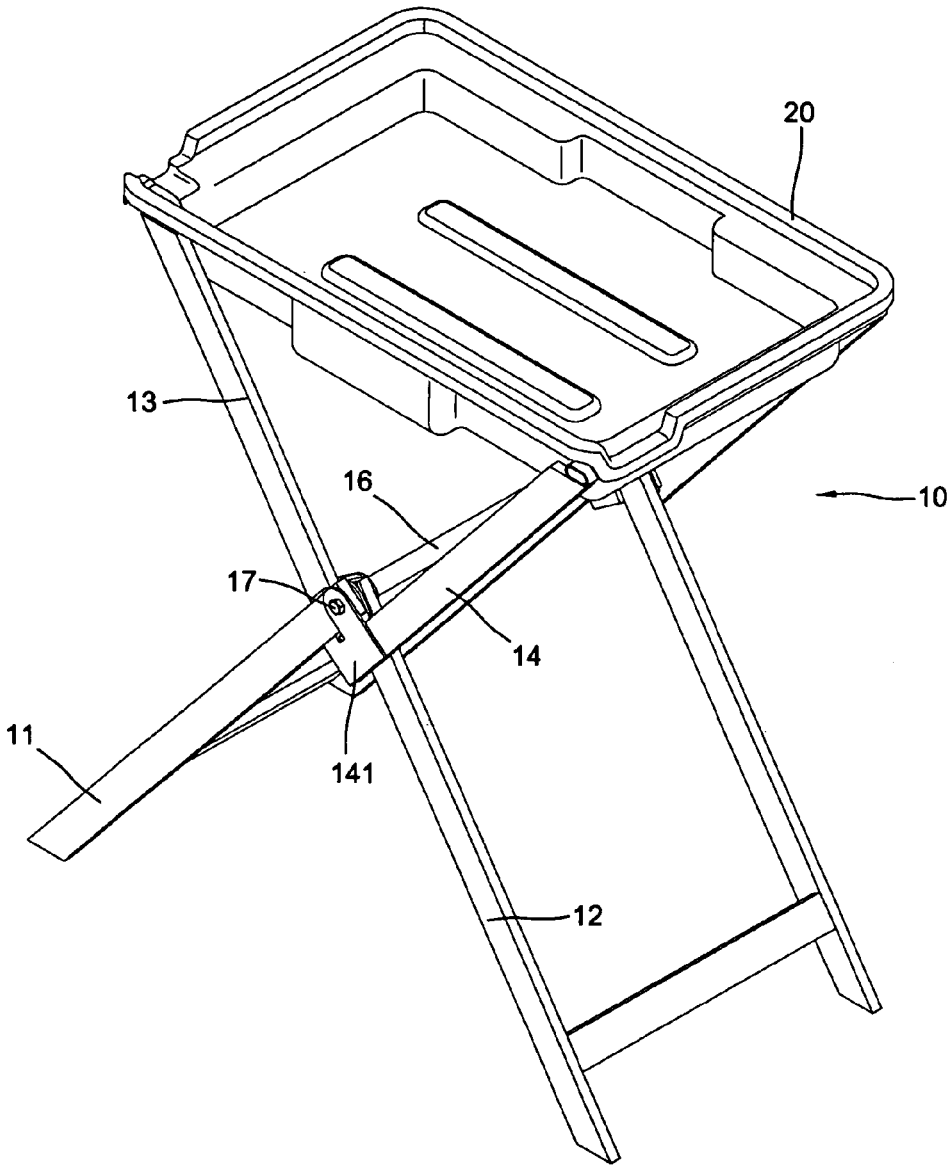
FIG. 10 shows that an object us supported on the foldable stand of the present invention.

As shown in FIG. 10, an object 20 can then be supported across the upper ends of the first and second upper parts 13, 14. Each of the parts 11, 12, 13, 14 is well positioned when in use so as to bear heavy object 20 supported thereon. The foldable stand 10 of the present invention can be easily folded to a compact assembly which is conveniently carried or stored.

While we have shown and described the embodiment in accordance with the present invention, it should be clear to those skilled in the art that further embodiments may be made without departing from the scope of the present invention.

What is claimed is:

1. A foldable stand comprising:

a first lower part having two separated upper ends;

a second lower part having two separated upper ends, two plates pivotably connected between the upper ends of the first lower part and the second lower part, the two upper ends of the second lower part located at insides of the two upper ends of the first lower part, each plate being an inverted V-shaped plate and having a first stop and a second stop extending from two sides thereof;

a first upper part having two separated lower ends and two first lugs extending from the two lower ends of the first upper part, a bar pivotably connected between the two first lugs, the two lower ends of the first upper part located at insides of the two upper ends of the second lower part, two first protrusions extending from the two lower ends of the first upper part respectively;

a second upper part having two separated lower ends and two second lugs extending from the two lower ends of the second upper part, the two second lugs pivotably connected to two outsides of the two upper ends of the first lower part, two second protrusions extending from the two lower ends of the second upper part respectively, and the first stops being in contact with the first lower part and the second stops being in contact with the second lower part when the first and second lower parts are pivoted about the plates an angle, the first upper part and the second upper part being upward pivoted, the two first protrusions being in contact with the second lower part and the two second protrusions being in contact with the first lower part, the first and second upper parts being positioned at an angle.

2. The stand as claimed in claim 1, wherein two bolts each extend through the second lugs, the first lower part, the plate, the second lower part, the first upper part and one of two ends of the bar.

* * * * *